United States Patent [19]

Sigman

[11] 4,255,871

[45] Mar. 17, 1981

[54] NAIL POLISH DRYER

[76] Inventor: John J. Sigman, 8579 Colony Dr., Algonac, Mich. 48001

[21] Appl. No.: 24,739

[22] Filed: Mar. 28, 1979

[51] Int. Cl.[3] ..... F26B 19/00

[52] U.S. Cl. ..... 34/243 R; 34/88; 34/202; 132/73.6; 132/75; 219/368; 219/370

[58] Field of Search ..... 34/88, 90, 103, 107, 34/202, 243 R; 219/368, 370; 132/9, 73.6, 75, 73.5

[56] References Cited

U.S. PATENT DOCUMENTS

| | | | |
|---|---|---|---|
| 1,961,179 | 6/1934 | Tinkham | 34/243 R |
| 2,277,282 | 3/1942 | Walborn | 34/88 X |
| 2,991,560 | 7/1961 | Cota | 34/243 R X |
| 3,258,853 | 7/1966 | Bradbury | 34/202 |
| 3,478,763 | 11/1964 | Weinstein | 132/75 |
| 3,637,982 | 1/1972 | Reaves | 34/202 X |
| 3,712,312 | 1/1973 | Sussman | 132/73.6 |

FOREIGN PATENT DOCUMENTS

| | | | |
|---|---|---|---|
| 1571422 | 6/1969 | France | 219/370 |

*Primary Examiner*—Albert J. Makay
*Assistant Examiner*—Harold Joyce
*Attorney, Agent, or Firm*—Whittemore, Hulbert & Belknap

[57] ABSTRACT

A nail polish dryer comprising an upwardly open bowl shaped body having a centrally located upward extension spaced inwardly from the periphery. The extension is provided with a support for the hand of the user which will position the nails of the thumb and fingers generally adjacent an annular space between the upward extension and the periphery of the body. Ports are provided surrounding the upward extension to direct drying air against the nails of the user. Preferably a switch activator is provided at the top of the upward extension adapted to be activated by the weight of the user's hand. A blower and preferably heating means are provided within the body and the blower directs heated air against the nails of the user.

6 Claims, 4 Drawing Figures

NAIL POLISH DRYER

DETAILED DESCRIPTION

Figure 2:
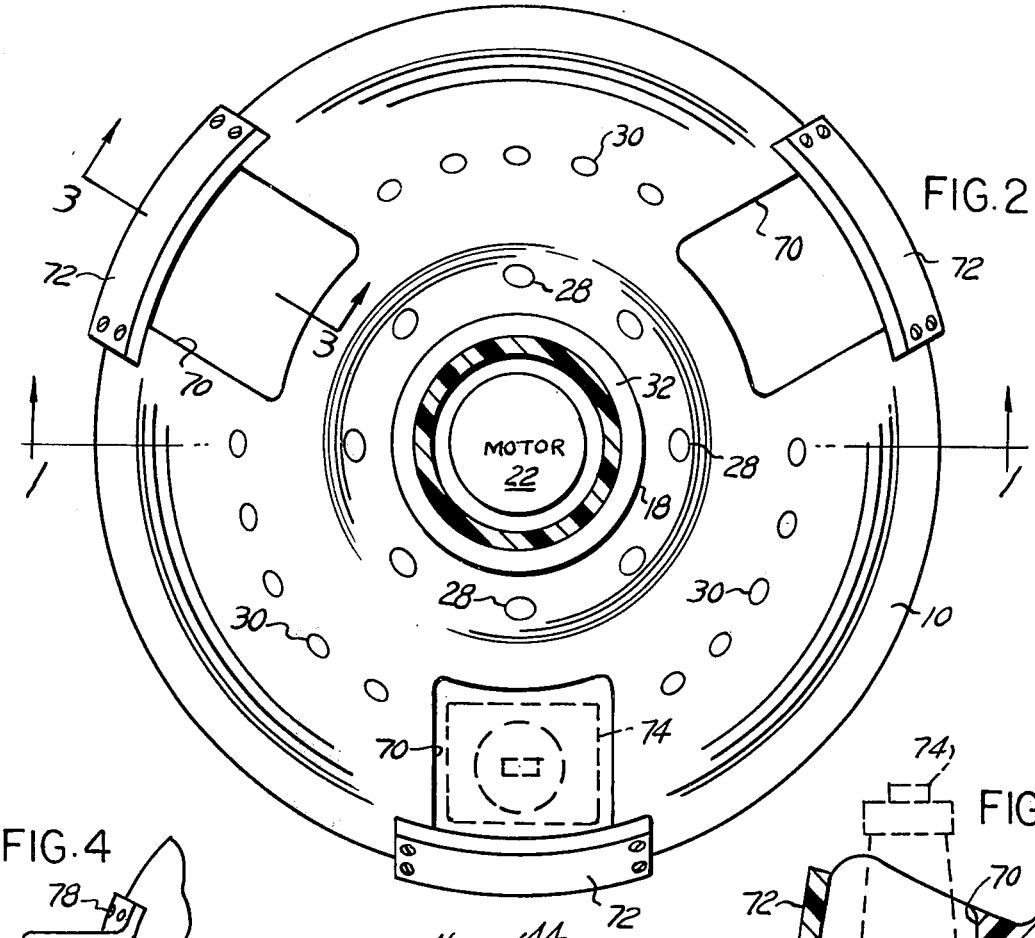
FIG. 2 is a vertical section on line 2—2, FIG. 1.

The nail polish dryer is in the form of a structure comprising a base 10 having an upwardly open bowl shaped portion including an inwardly and downwardly inclined bottom wall 12 having an upwardly extending periphery 13 and a centrally located upward extension indicated generally at 14 defining therebetween an upwardly open annular space having the inwardly and downwardly inclined bottom wall 12.

More specifically, the base comprises a lower portion having a peripheral flange 16 of circular cross-section and a centrally located upwardly extending generally conical housing portion 18 which is hollow to provide a tubular portion indicated at 20 for the reception of an electric motor 22. The base 10 includes a downwardly extending tubular flange 24 adapted to receive an air blower 26.

A plurality of air inlet ports 28 are provided which communicate with the air blower 26 and a plurality of discharge parts 30 are provided in the inclined bottom wall which are directed inwardly and upwardly so that air passing therethrough is directed toward the nails of the user.

Resting on flange 32 is a generally ball-shaped or spherical hand support comprising a lower portion 34 and an upper portion 36. Portions 34 and 36 are hollow and together define a closed space 38 which receives a switch 40 having an actuating leaf 42 adapted to being engaged by the lower end of a switch activator 44 which is substantially housed within a recess 46 located in the member 36. Suitable means such for example as a flexible leaf spring 48 retain the switch activator 44 elevated until it is depressed by the weight of the user's hand.

The motor 22 as indicated is mounted by screws 50 to a closure plate 52 closing the upper end of the tubular portion 20 of the base by a removable plate 54 as by screws 56 engaged in ribs 58. Within the hollow interior of the base 10 there is provided an electrical resistance heater element as indicated at 60 which are provided in opening 62 in a plate 64. With this arrangement energization of the motor which discharges downwardly into the space below the plate 64, directs air in through the ports 28 and this air exits through the opening 62 over the heater element 60 and thence through the ports 30, where the heated air is directed against the nails of the user.

It will be understood of course that the switch 42 controls both the motor 22 and the heating element 60. Also if desired an electrical illuminating bulb 66 may be provided in which case the support portions 34 and 36 will be made of a translucent material. The light from the bulb not only provides a pleasing appearance but also is an indication that the circuit has been completed to the motor 22 and electrical heating elements.

If desired the heating element may be controlled by a thermostat 68 suitable connected into the circuit supplying the heating element 60.

Preferably the base 10 and the support portions 34, 36 and the switch activator 44 will are all formed of suitable plastic and may be economically fabricated by casting or preferably by injection molding.

Figure 3:
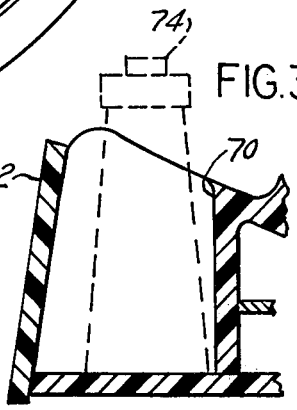
FIG. 3 is a fragmentary section on line 3—3, FIG. 1.
Figure 4:
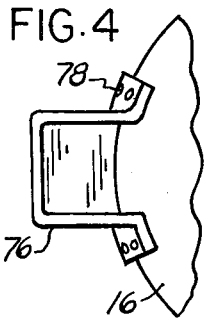
FIG. 4 is a fragmentary plan view showing a modification of the invention.
Figure 1:
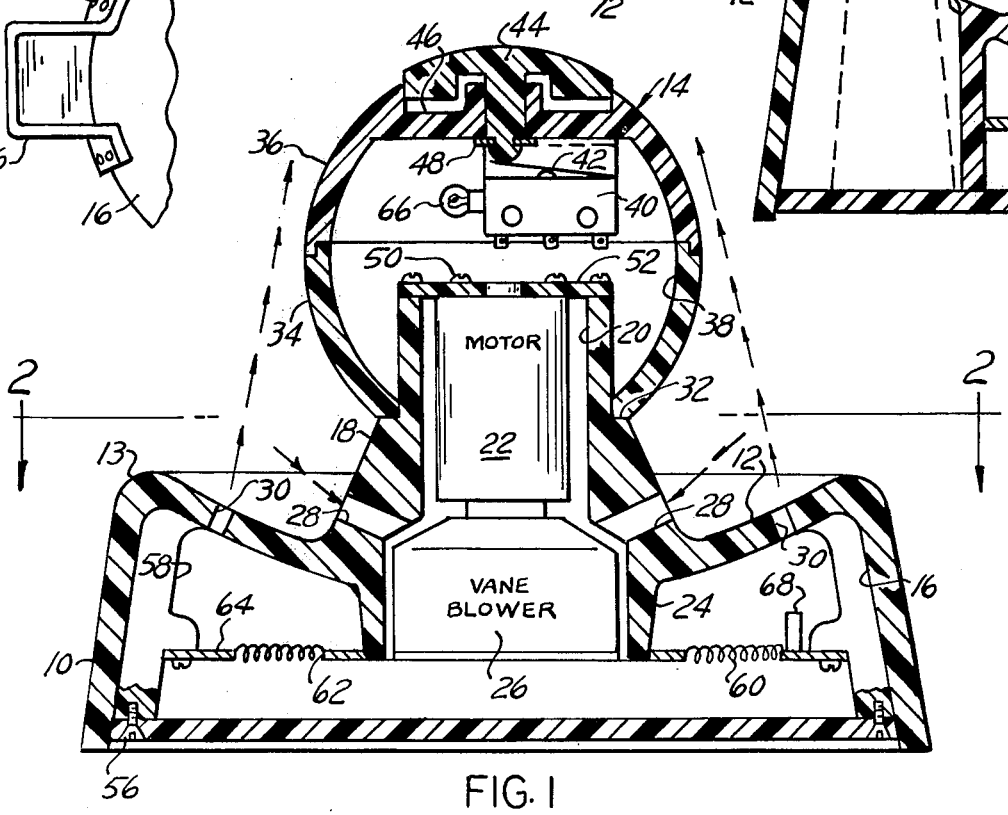
FIG. 1 is a plan view particularly in section of the nail polish dryer.

In FIG. 3 there is illustrated a modification of the broad concept as previously described in which the base 10 is recessed as indicated at 70 and provided with removable closures 72 for the recess which together define pockets for the reception of containers 74 for nail polish, polish remover, etc.

Alternatively the base 10 may be of uninterrupted uniform cross-section and one or more containers indicated generally at 76 may be attached to the flange or wall 16 as for example by fastening elements indicated at 78.

While the invention is illustrated as comprising a switch 40 adapted to be activated by the weight of the user's hand resting on the activator 44 it will of course be apparent that a separate switch may be provided at a different location. Similarly it will be apparent that while the invention is illustrated as including electrical heater elements 60, these may be omitted if desired, as may be the illuminating means 66. The motor and/or heating elements may be connected by a cord to a wall outlet, but preferably are energized from a battery (not shown) provided in the base.

The foregoing construction is readily assembled from readily manufactured parts and provides a very simple and efficient device which requires only that the hand of the user be placed around the generally spherically upward extension, in which case the fingers and thumb of the user will naturally curl into the position in which the nails are directly impinged by air, and presumably heated air, directed through the ports 30.

It will be noted that upper portion 36 of the spherical hand support constitutes essentially a hemisphere, while lower portion 34 constitutes a major portion of a hemisphere, so that together, lower portion 34, of the hand support, conical housing portion 18, and inclined bottom wall 12 define an upwardly and outwardly open channel adapted to receive the finger and thumb tips of the user's hand and to position the nails thereof in position to be impinged by drying air.

What is claimed is:

1. A nail polish dryer comprising an upwardly open generally bowl shaped body having an upwardly extending 360° periphery and a centrally located upward extension spaced inward from said periphery to define therewith an upwardly open annular channel having an inwardly and downwardly inclined annular bottom wall, said extension having at its top a generally spherically shaped hand support comprising substantially more than half of a complete sphere so that the lower portion thereof is curved downwardly and inwardly and is dimensioned to be manually engaged in such a way that the user's palm engages the top of said hand support and the fingers and thumb of the user extend downwardly toward the annular channel with the nails thereof generally in facing relation to said periphery, the bottom wall of said channel adjacent said periphery having a plurality of ports through which drying air is directed generally upwardly and radially inwardly against the nails of the user, and blower means for forcing drying air through said ports to said annular space.

2. A nail polish dryer as defined in claim 1, in which the air blower means is in said body and is connected to discharge air through said ports.

3. A nail polish dryer as defined in claim 2, comprising electrical resistance air heating means within said body between said blower means and said ports.

4. A nail polish dryer as defined in claim 2, in which said air blower means comprises an electric motor, and a switch controlling said motor carried by said body.

5. A nail polish dryer as defined in claim 3, in which said switch comprises a switch actuator located at the top of said upward extension to be operated by the hand of the user when in position such that drying air is projected from said ports onto the nails of the user.

6. A nail polish dryer as defined in claim 4, comprising electrical resistance air heating means within said body between said blower means and said ports.

* * * * *